US006581300B1

(12) United States Patent
Grebe et al.

(10) Patent No.: US 6,581,300 B1
(45) Date of Patent: Jun. 24, 2003

(54) METHOD FOR DRYING VENEER AND CORRESPONDING DRYING DEVICE

(75) Inventors: Ingo Grebe, Neuenstein (DE); Helmut Wünsche, Hauneck (DE)

(73) Assignee: Babcock-BSH GmbH, Bad Hersfeld (DE)

( * ) Notice: Subject to any disclaimer, the term of this patent is extended or adjusted under 35 U.S.C. 154(b) by 0 days.

(21) Appl. No.: 10/019,423

(22) PCT Filed: Feb. 19, 2000

(86) PCT No.: PCT/EP00/01383

§ 371 (c)(1),
(2), (4) Date: Dec. 20, 2001

(87) PCT Pub. No.: WO00/53984

PCT Pub. Date: Sep. 14, 2000

(30) Foreign Application Priority Data

Mar. 11, 1999 (DE) ..... 199 10 832

(51) Int. Cl.[7] ..... F26B 7/00

(52) U.S. Cl. ..... 34/396; 34/429; 34/444; 34/619

(58) Field of Search ..... 34/380, 391, 393, 34/396, 418, 419, 423, 428, 429, 443, 444, 618, 619, 620, 90, 92

(56) References Cited

U.S. PATENT DOCUMENTS

| | | | | | |
|---|---|---|---|---|---|
| 4,193,207 A | * | 3/1980 | Allen et al. | ..... | 34/380 |
| 4,308,667 A | * | 1/1982 | Roos et al. | ..... | 34/484 |
| 4,654,981 A | | 4/1987 | Grebe et al. | | |
| 4,738,035 A | * | 4/1988 | Grebe et al. | ..... | 34/114 |
| 4,862,600 A | * | 9/1989 | Cremona | ..... | 34/117 |
| 5,935,629 A | | 8/1999 | Martin | | |
| 6,108,942 A | * | 8/2000 | Fezer | ..... | 34/636 |

FOREIGN PATENT DOCUMENTS

| | | | | | |
|---|---|---|---|---|---|
| DE | 2 414 654 | | 10/1974 | | |
| DE | 3627721 | A1 * | 2/1988 | ..... | F26B/15/18 |
| DE | 37 06 353 | | 9/1988 | | |
| DE | 41 09 298 | | 4/1992 | | |
| DE | 42 17 493 | | 11/1992 | | |
| EP | 0 152 576 | | 10/1993 | | |
| FR | 2 290 282 | | 6/1976 | | |
| FR | 2 580 063 | A1 * | 10/1986 | ..... | F26B/3/20 |
| JP | 01174880 | A * | 7/1989 | ..... | F26B/15/18 |
| JP | 01174881 | A * | 7/1989 | ..... | F26B/15/18 |

* cited by examiner

*Primary Examiner*—Ira S. Lazarus
*Assistant Examiner*—Andrea M. Ragonese
(74) *Attorney, Agent, or Firm*—Herbert Dubno

(57) ABSTRACT

A method and apparatus for drying veneer wherein the feeder upstream of the drying station displaces the veneer at different speeds on the right and left sides of the transport path of the veneer as seen in the direction of transport so as automatically to impart an inclined orientation of the veneer of 20° to 60° to a line perpendicular to the transport direction before the veneer reaches the drying station. In the drying station and the cooling station the veneer retains this inclined orientation and in these stations the veneer is subjected to multiple rerouting or the application of pressure.

10 Claims, 8 Drawing Sheets

METHOD FOR DRYING VENEER AND CORRESPONDING DRYING DEVICE

CROSS REFERENCE TO RELATED APPLICATIONS

This application is the US national stage of PCT/EP00/01383 filed Feb. 19, 2000 and is based upon German national application 19910832.3 filed Mar. 11 1999.

FIELD OF THE INVENTION

The invention relates to a method of drying veneers especially Messerfurnieren or sliced veneers as well as to a drying apparatus for carrying out the method.

BACKGROUND OF THE INVENTION

It is generally used practice to the individual veneer sheets which are moist veneers as cut by the slicing machine, to a dryer to evaporate water to a predetermined residual moisture content and then to cool the veneers, to count them and to stack them. The veneers are so fed to the dryer that the fiber direction of the veneer is approximately at a right angle to the transport direction.

A feed device and a discharge device, each having a respective suction box are known from DE 25 23 482 A1. The applicant is also aware of a feed device which is a combination of suction boxes and a transport system equipped with belts and of a discharge device with a transport system having belts.

By the term "dryer," for the purposes of the description to follow, a so-called sheet dryer is to be understood. With such a system two transport belts—a support belt and a cover belt—are provided which lie directly parallel one above the other and between which the veneer is transported through the dryer with at least the not insignificant part of the transport path having multiple rerouting so that the veneer is alternately bent upwardly downwardly. The rerouting can be achieved in this case in various ways. Alternatively, pressure is applied by rollers on the upper transport belt.

In EP 0 152 576 B2, a dryer of this type is described in which the belt travel after a straight segment has loops around rollers with relatively large diameters, whereby a short linear segment is formed between two neighboring rollers.

EP 0 290 056 A2 describes a dryer of the type described with a sine-wave-shaped belt path which is achieved by many rollers of small diameter. Additional rod-shaped rollers can be used as well.

In DE 41 09 298 C2, a flattened omega configuration with a corresponding linear path is described for the transport belts in which there are a plurality of rollers forming the guide paths with at least the second and fourth rollers in the direction of the dryer inlet being spaced from the first and third rollers whereby the second and third rollers lie in a plane above the plane of the first and fourth rollers and the spacing of the two planes is less than the diameter of a roller.

DE 42 17 493 A1 described a zigzag belt travel which is achieved by offset rerouting rollers lying one above another.

In the dryer described in DE 37 06 353, the travel direction of the transport belts is approximately rectilinear. With the aid of vertically pressing rollers, which are offset in the transport direction and are arranged parallel to the support rollers, a sufficient pressure is generated on the veneer.

In the cooler, the transport belts are guided similarly to their pattern in the dryer.

The purpose of a sheet dryer is to smooth out corrugations in the veneer during the drying and cooling period. By comparison to dryers and coolers with straight belt paths and without the effect of pressure, a significantly better smoothing is obtained with most types of wood. However, with sensitive kinds of wood like, for example, beech, walnut and cherry wood, folds and cracks can arise which can make the veneer at least partly unusable. The waste can amount of 10 to 20%.

OBJECTS OF THE INVENTION

It is an object to provide a method for the drying of veneers which is applicable also for difficult to dry wood types and by means of which an unobjectionably smooth veneer can be obtained and in which the waste as a result of folds and cracks is minimized.

A further object is to provide a drying apparatus for carrying out the method according to the invention.

SUMMARY OF THE INVENTION

The first object is achieved with a method of drying veneers, especially sliced veneers, with at least the method steps of feeding, drying, optionally cooling and discharging the veneer, whereby the veneer during drying and optionally during cooling is rerouted a multiplicity of times between two transport belts and/or is exposed to pressure. According to the invention the veneer is given an inclined orientation during the feeding whereby the angle between the fiber direction of the veneer and a line perpendicular to the transport direction of the dryer amounts to 20° to 60°, and that the veneer is dried and cooled in this inclined orientation.

Preferably the veneer upon discharge is brought from an inclined orientation into an orientation approximately at a right angle to the transport direction.

The veneer during the feeding and optionally during the discharge, as seen in the transport direction is transported with different speeds at the left and the right.

Because of the inclined orientation of the veneer in the dryer and in the cooler, a component of the crimping action tends to be applied in the fiber direction at the rerouting location. It has been found that all dried veneer leaves the dryer in this case without folds or cracks when the fiber direction of the veneer during the transport through the dryer and the cooler is inclined to the transport direction rather than as heretofore customary at right angles thereto.

Claims 2 and 3 facilitate the manual effort to service personnel.

The dependent claims 5 to 10 contain the preferred embodiments of a drawing device according to the invention. The features ensure a reliable operation of the drying device.

The inclined orientation, that is the angle between the fiber direction of the veneer and a line at a right angle to the transport direction, is provided by the insertion of the veneer into the dryer at a predetermined angle of 20° to 60° and preferably 30° to 50°.

In the feed direction, the speeds of the veneer in the transport direction to the right and left are set differently so that the transfer of the veneer onto the support belt, that is the lower transport belt of the dryer, assumes the correct inclined position. During the drying and the cooling, the veneer is fixed in this position because it is mechanically held between the transport belts. The discharge device largely cancels the inclined position because of different speeds which correspond to the inverse of those in the feed device to facilitate further handling. The service personnel thus need not become accommodated to a different discharge or handling.

A preferred embodiment is the use of different diameters of the driven belt disks.

The use of individually driven belts enables a very flexible manner of travel and matching of the inclined orientation during the operation.

The brake device can be retrofitted to existing apparatus in a simple manner. Claims 9 and 10 indicate preferred embodiments of the brake device.

BRIEF DESCRIPTION OF THE DRAWING

The drawings serve for explanation of the invention based upon simplified and schematically illustrated embodiments.

SPECIFIC DESCRIPTION

Figure 1:
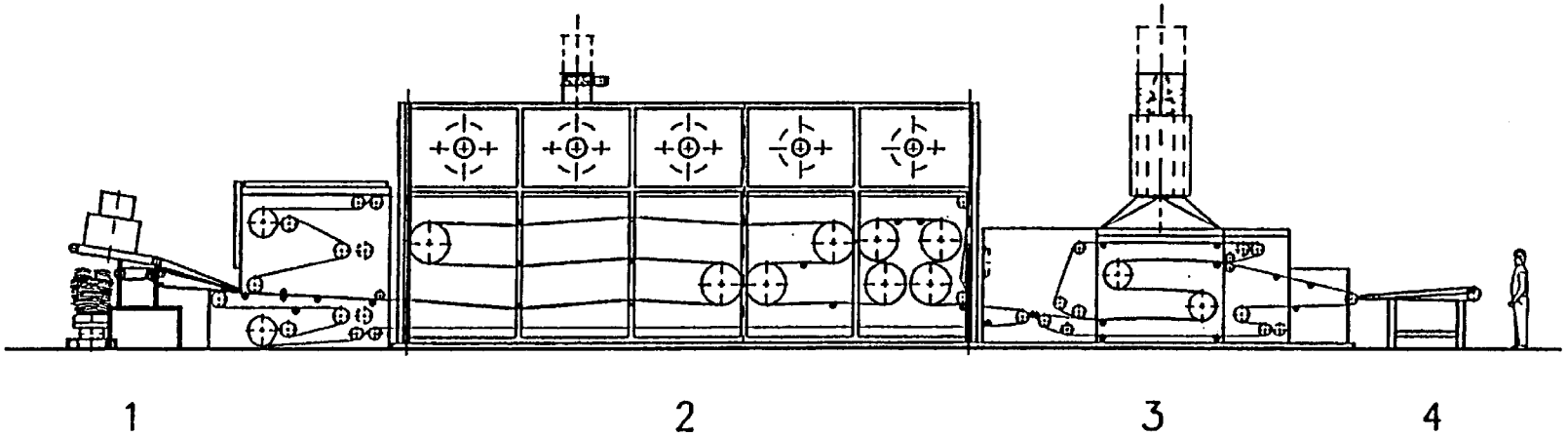
FIG. 1 shows a longitudinal section through the drying apparatus according to the invention.

As is visible from FIG. 1, a drying apparatus is comprised of a feed device 1, a dryer 2, a cooler 3 and a discharge device 4. Each of the individual devices of the drying apparatus has its own transport system. The speeds of the individual transport systems are matched to one another and depend upon the drying process.

Figure 2:
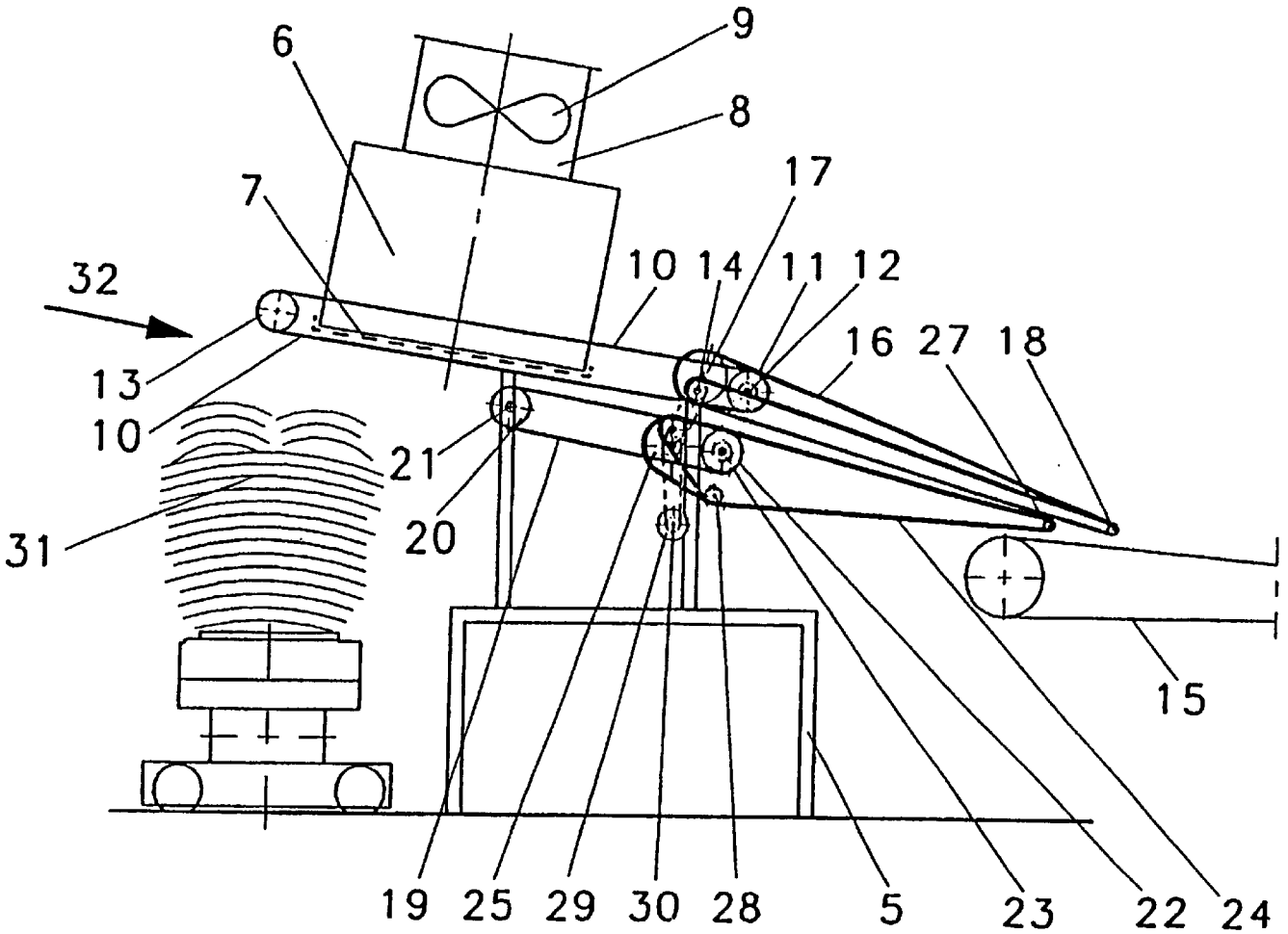
FIG. 2 shows a side view of a feed device as a detail.
Figure 2A:
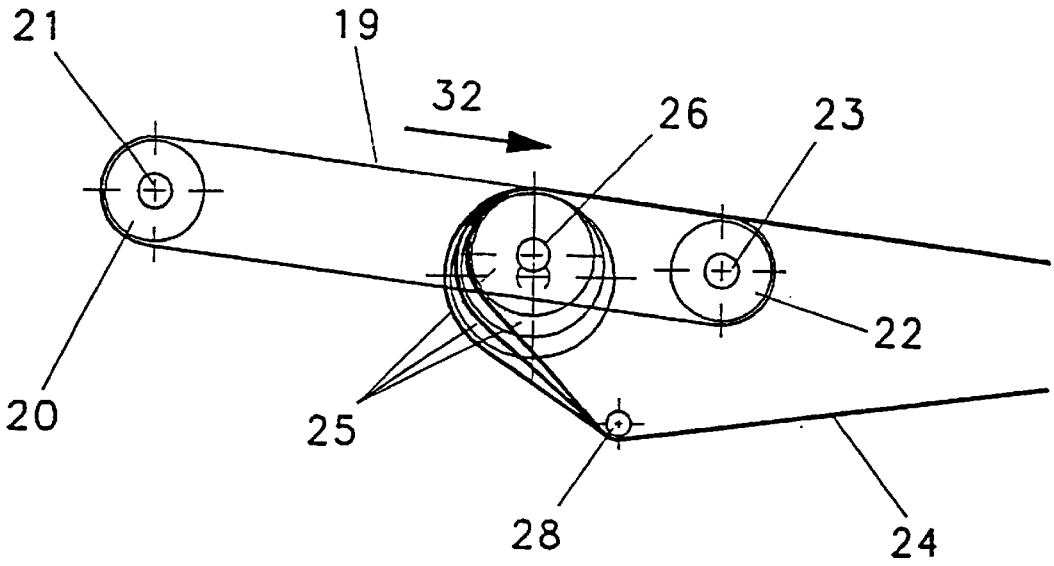
FIG. 2*a* shows a detail of FIG. 2.
Figure 3:
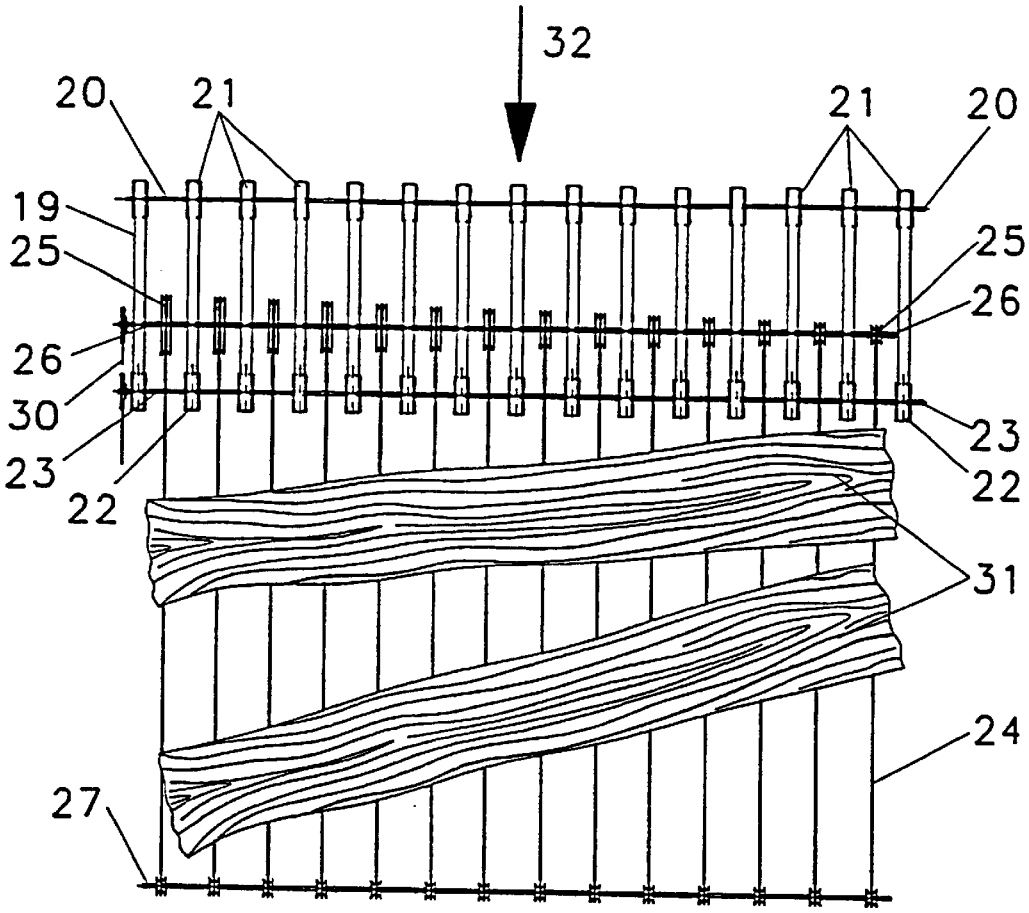
FIG. 3 shows the lower belt system according to FIG. 2 as seen vertically from above.
Figure 4:
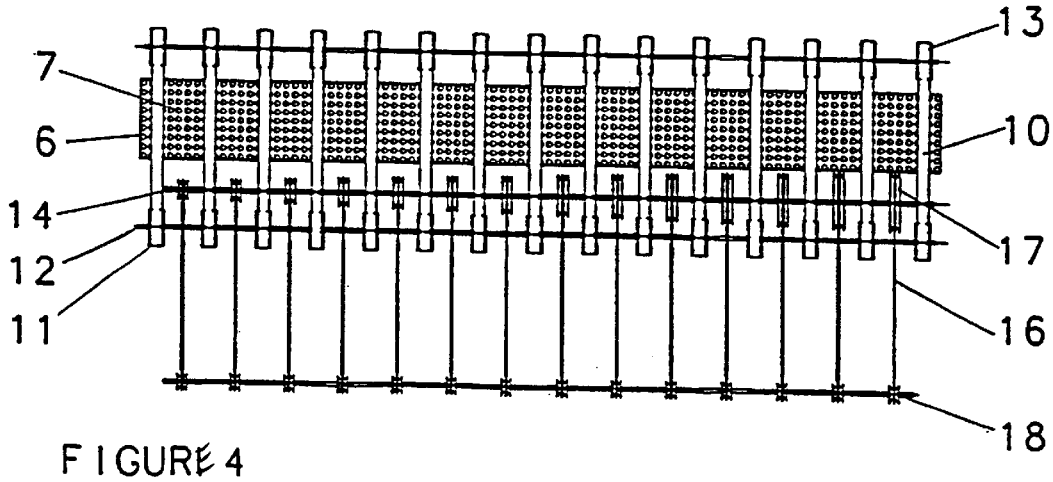
FIG. 4 shows the upper belt system according to FIG. 2 vertically from below.

The feed device 1 which is illustrated in detail in FIGS. 2 to 4 is equipped for the semiautomatic delivery of the moist veneer. On a frame 5 there are fastened a suction box 6 and a transport system with belts 10, 16, 19 and 24 arranged parallel to one another. The belts 10, 16, 19, 24 are arranged next to one another and are guided each over two spaced apart belt disks or over one belt disk and a spaced rerouting member. The belt disks or pulleys are each fastened on a shaft. The arrow 32 indicates the transport direction.

The suction box 6, of a block-shaped sheet metal construction with perforated sheet metal 7 on its underside is connected with a suction pipe 8 with a blower 9 which is arranged on the suction box. The suction box 6 extends over the entire width of the transport plane and is horizontal in its longitudinal direction while it is slightly inclined downwardly in the transport direction.

The transport system for the feed device 1 is comprised of an upper belt system and a lower belt system. The upper belt system is bipartite. In the region of the suction box 6, the endless belts 10 have flat rectangular cross sections. They are guided below the suction box along the perforated plate 7 up to the belt disk 11 on the drivable shaft 12 which is mounted parallel to but spaced from the rear lower longitudinal edge of the suction box 6, and back through the suction box 6 and around the rerouting member 13 ahead of the front lower longitudinal edge of the suction box 6 to the perforated plate 7. The shaft 12 and the rerouting member 13 are mounted at a distance from one another. All belt disks 11 have the same diameter. The second region of the upper belt system begins at the drivable shaft 14 which is mounted parallel to the shaft 12 between the suction box 6 and the shaft 12 and runs up to the support belt 15 and the dryer 1. The endless belts 16, for example with round cross sections are here guided by the belt disks or pulleys 17 on the shaft 14 over a cantilever arm of the frame 5 up to a rerouting member 18 which is parallel to the shaft 14, and back to the belt pulleys 17. The cantilever arm is swingable vertically around the shaft 14 so that the height of the rerouting member 18 is adjustable. The belt pulleys 17 have different diameters so stepped that a linear speed distribution is provided in the transport direction as seen from left to right. The shaft 14 is mounted at an inclination from the horizontal so that the lower edges of the belts 16 on the belt pulleys 17 are flush with the perforated plate 7. The belt pulleys 17 and the rerouting member 18 have on their inner peripheries, for example, semicircular recesses in which the belts 16 are guided. The lower belt system is arranged beneath the upper belt system. The lower belt system is bipartite. In the front region, which begins beneath the last third of the suction box 6 as seen in the transport direction and ends in the region below the shaft 12, all of the belts 19 are driven at the same speed. The endless belts 19 of flat rectangular cross section, are guided over the belt disks 20 on the shaft 21 and the belt disks 22 on the drivable shaft 23. The belt disks 20 and 22 associated with each shaft 21, 23 have respectively the same diameter. In the second region, the endless belts 24 have for example a round cross section and are guided on the belt pulleys 25 on the shaft 26 which is mounted as seen in the transport direction, shortly ahead of the shaft 23 via the cantilever arm, the rerouting member 27 and the tension rollers 28. The belt pulleys 25 have different diameters stepped and pass through recesses in peripheral surfaces of the rerouting member, which corresponds generally to the cross section of the belts 24 and in which the belts 24 are guided. The shaft 26 is mounted with an inclination from the horizontal so that the upper edges of the belts 24 guided on the belt pulleys 25 are flush with the transport surface.

The belt disks 11, 17, 20, 22 and 25 are each affixed to the respective shaft 12, 14, 21, 23, 26.

The diameters of the belt disks 17 and 25 which differ are so determined with respect to one another that the speed of the belt decreases continuously from left to right or the reverse, as seen in the transport direction and so that the transport speed of the veneer varies similarly.

The belts 10, 16, 19, 24 are drivable via a drive system with, for example, a motor/transmission 29 and a chain drive 30.

In operation, the service person lifts a leaf of veneer so that at least the part is disposed in the suction region of the suction box 6 and is then fully pressed against the perforated plate 7 and the belts 10. The belts 10 of the feed device 1 transport the veneer 31 along the perforated plate 7 in the direction of the dryer 2. at the end of the suction box 6, as seen in the transport direction, the veneer 31 falls onto the lower belt system and is transported with an average transport speed which corresponds to that in the dryer 2 until it reaches the support belt 15. During this transport, the veneer 31, as a consequence of the speed differences of the belts 16 and 24 is offset into the desired inclined orientation. The requisite speed difference is readily calculated from the transport stretch between the shaft 26 and the rerouting member 27 as well as the angle of the inclined orientation.

Figure 5:
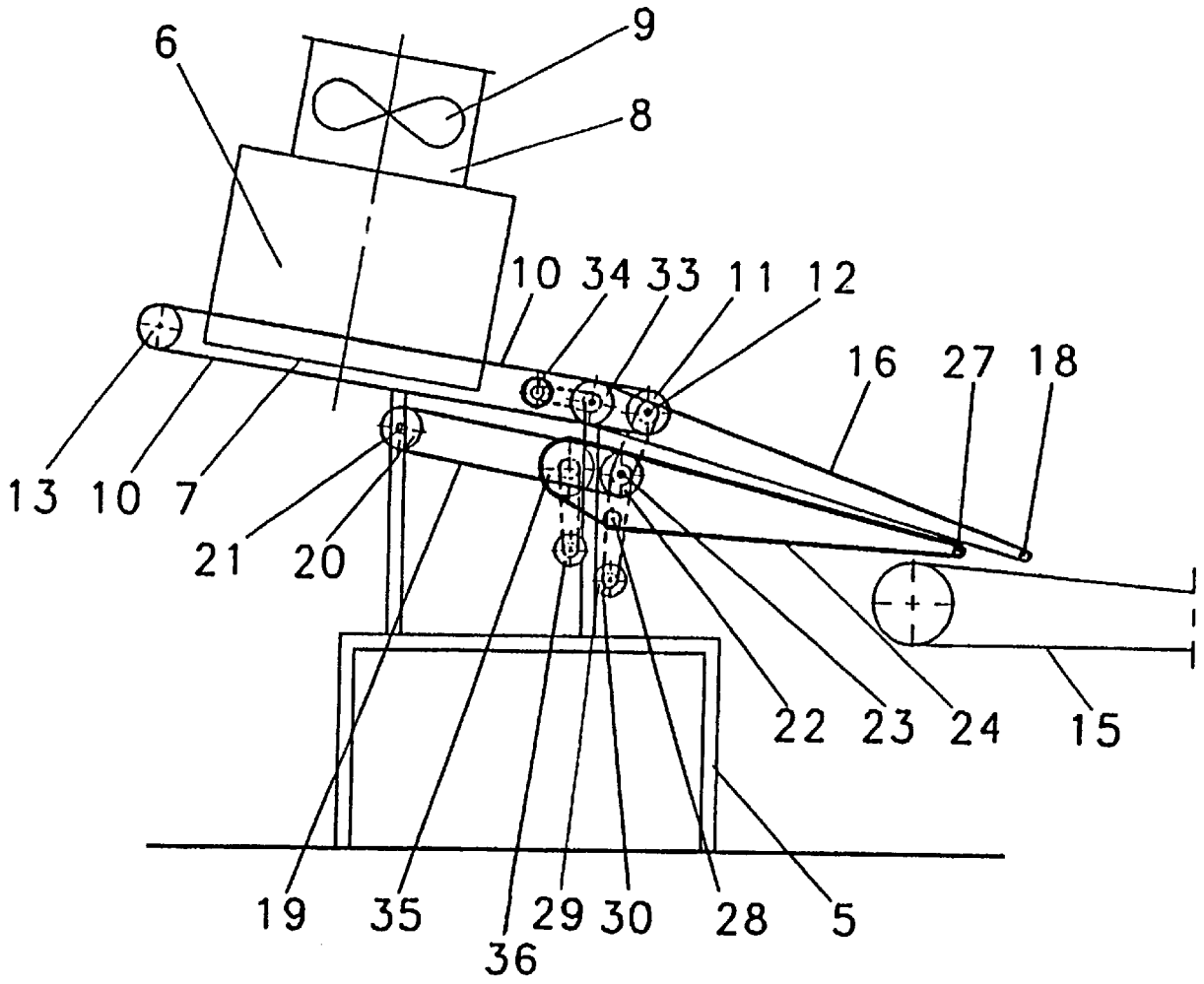
FIG. 5 shows a side view of a feed device according to claim 7 as a detail.
Figure 6:
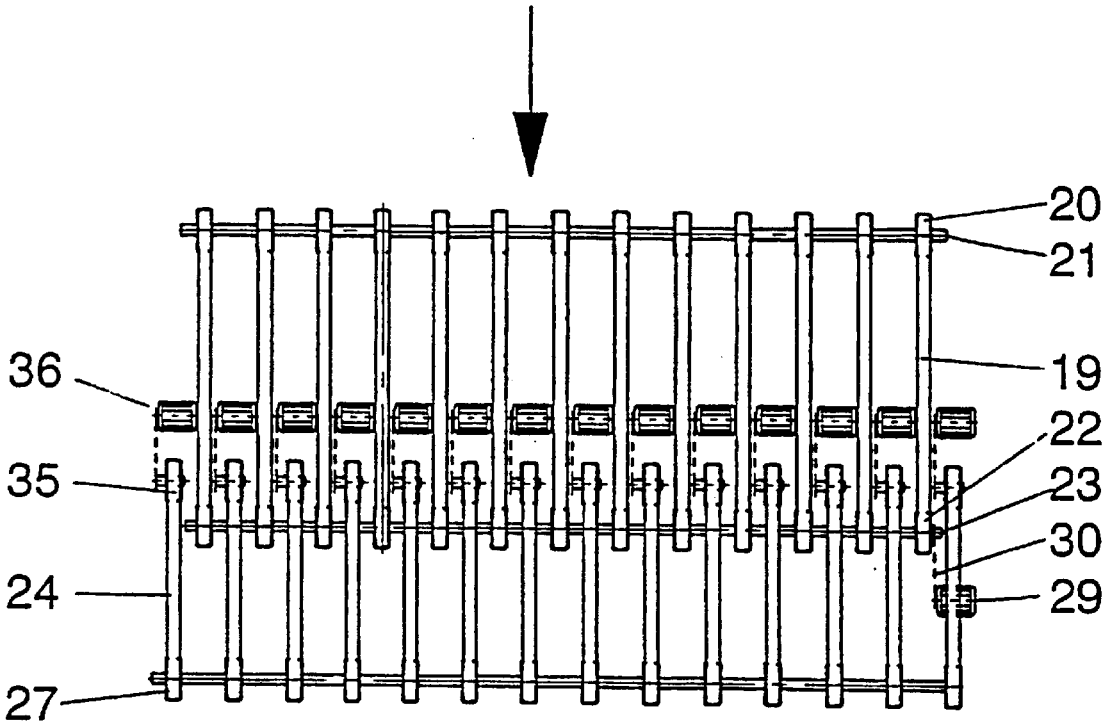
FIG. 6 shows the lower belt system according to FIG. 5 as seen vertically from above.

Another embodiment of the invention is illustrated in FIGS. 5 and 6. The construction corresponds to the previous description with the difference that the different speeds of the belts 16, 24 which here can also be flat belts, is achieved by individual drives 34, 36:

The shaft 12 is drivable together with shaft 23 of the lower belt system. The belt disks 33, which all are of the same size, are individually mounted between the shaft 12 and the suction box 6. The rotary axis of the belt disks 33 is parallel to the shaft 12. Each belt disk 33 has its own controllable drive 34.

The belt disks 35 are of equal size but are individually journaled and have each a respective controllable drive 36.

In operation the speeds of the drives 34, 36 are so controlled that the speed of the belts 16, 24 decreases from left to right or the reverse and the desired inclined orientation of the veneer 31 is achieved whereby in the middle, the transport speed which is dependent upon the process is maintained.

The invention also encompasses other arrangements and drive possibilities which permit different belt speeds.

Figure 7:
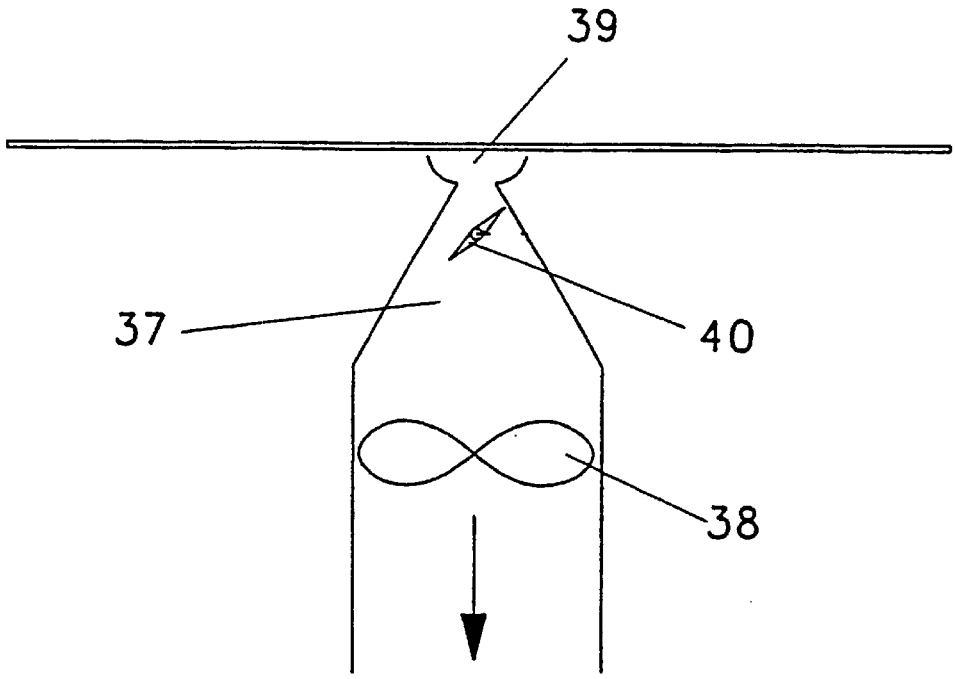
FIG. 7 shows a brake device.

A further embodiment of the invention has been illustrated in FIG. 7. The construction corresponds to that of FIGS. 2 to 4 with the difference that the belt disks 17, 25 have the same diameter and in that a brake device is installed.

The brake device is offset from the center in about ⅔ of the width of the feed device 1 below or above the transport plane between two neighboring belts 16, 24. The brake device is comprised of a nozzle 37 with an internally mounted suction blower 38 and an opening 39 trained upon the transport plane. The opening is located directly proximal to the transport plane. A flap 40 is disposed between suction blower 38 and opening 39.

In operation the suction blower 38 generates a subatmospheric pressure in the nozzle 37. The flap 40 is closed. At the moment that a veneer leaf passes nozzle 37, the flap 40 opens. As a consequence of the pressure drop, the veneer 31 is pressed against the opening 39 and held on one side while the other side of the veneer 37 is further transported. After a certain time interval which is determined by the transport speed and the desired inclined orientation, the flap 40 closes and the nozzle 37 liberates the veneer 31 which has reached the position now at the desired angle. The further transport up to the support belt 15 of the dryer 2 is now effected uniformly on both sides of the veneer 31 so that its orientation is maintained.

Instead of the suction blower 38, an external vacuum source can be connected to the nozzle 37.

Figure 8:
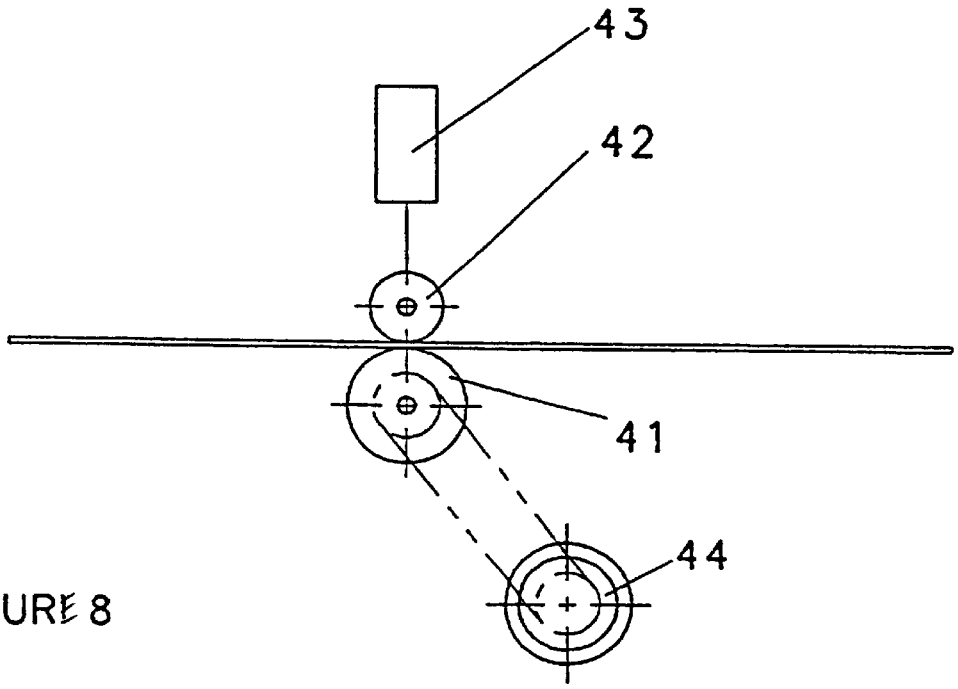
FIG. 8 shows another brake device.

Another embodiment of a brake device according to claim 10 is illustrated in FIG. 8. The drivable disk 41 is disposed beneath the transport path at a slight spacing between two neighboring belts 16, 24 at about ⅔ of the width of the feed device 1. The upper tangent to the disk 41 is flush with the. transport path. The rotation axis is at a right angle to the transport direction. Above the disk 41 a rotatably mounted disk 42 is affixed on a ram 43. The rotary axis of the disk 42 is vertically above and parallel to the rotary axis of disk 41. The ram 43 can be raised and lowered for example by a pneumatic system or an electromagnetic system.

Figure 9:
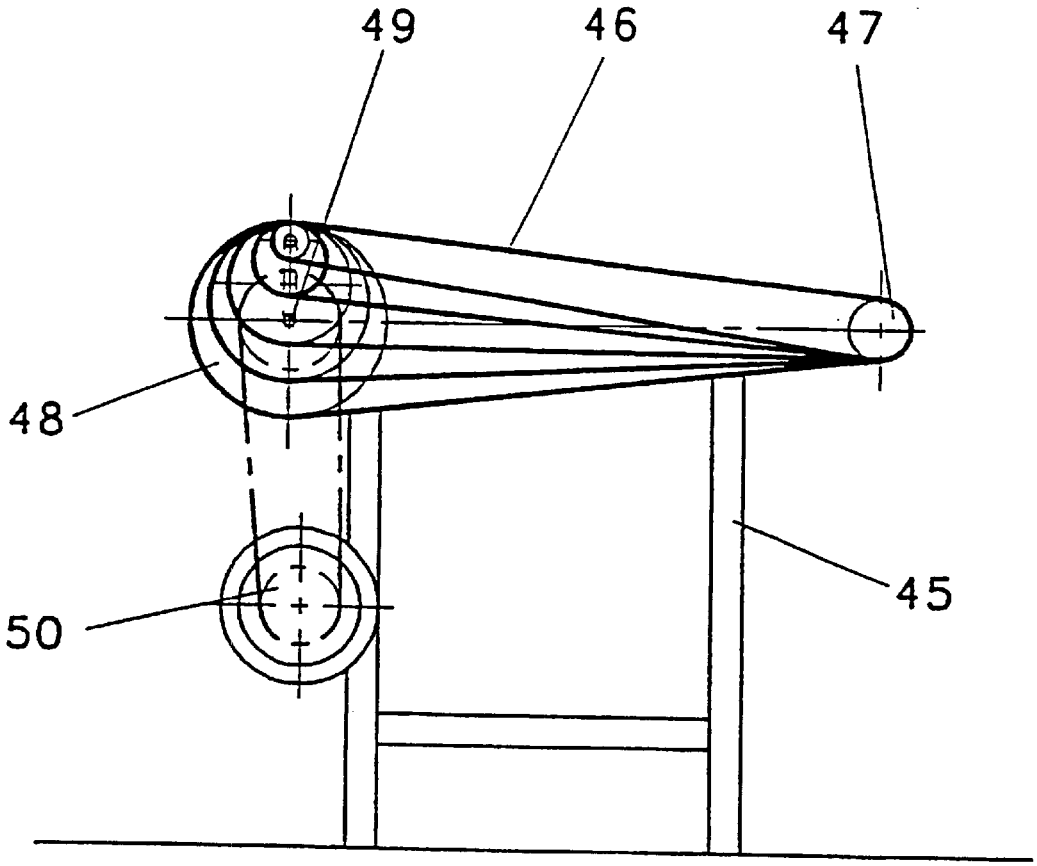
FIG. 9 shows a side view of a discharge device in a detail.

The disk 41 is continuously driven slowly via for example a drive motor 44. The direction of rotation of the disk 41 corresponds to the transport direction, the peripheral speed is substantially slower than the transport speed of the belt system. As soon as a veneer sheet 31 is disposed above the disk 41, the ram 43 extends so that the disk 42 presses the veneer 31 against the disk 41. Because of the reduced circumferential speed of the disk 41, the veneer 31 is braked on one side and thus drawn into an inclined orientation. As soon as the requisite inclined orientation is reached the ram 43 is retracted and liberates the veneer 31 so that it is transported in the imparted inclined orientation to the support belt 15. A discharge device 4 is illustrated in FIG. 9 as a detail. On a frame 45 there is disposed a transport system with belts 46. The round belts are guided from the belt disks 48 on the driven shaft 49 over the rerouting member 47 and back. The belt disks 48 have different mutually stepped diameters. They are arranged to return the veneer 31 from the inclined orientations in the dryer 2 and cooler 3. The shaft 49 is thus mounted at an inclination such that the upper edges of the belts 46 guided on the belt disks 48 are flush with the transport path. The shaft 49 is coupled with a drive 50.

We claim:

1. A method of drying veneer, comprising the steps of:

(a) feeding veneer in a transport direction and in a transport plane to a drying station;

(b) during the feeding of said veneer and upstream of said drying station imparting to said veneer an inclined orientation of fibers thereof of 20° to 60° in said plane to a line perpendicular to said transport direction;

(c) conveying the veneer with said inclined orientation through said drying station and drying said veneer in said drying station while in said inclined orientation;

(d) thereafter conveying the veneer with said inclined orientation through a cooling station and cooling dried veneer in said cooling station;

(e) subjecting the veneer in at least one of said stations to a treatment selected from:

(e1) multiple reroutings between a pair of belts, and (e2) application of pressure to the veneer; and (f) discharging cooled veneer from said cooling station.

2. A method of drying veneer in a dryer with at least the method steps of feeding, drying, cooling and discharging the veneer, whereby the veneer along a transport path of the veneer, whereby the veneer during drying and during cooling is rerouted a multiplicity of times between two transport belts or is exposed to pressure wherein the veneer is given an inclined orientation during feeding whereby an angle between a fiber direction of the veneer and a line perpendicular to a transport direction of the dryer amounts to 20° to 60°, and wherein the veneer is dried and cooled in said inclined orientation, the veneer upon discharge being brought from said inclined orientation into an orientation approximately at a right angle to the transport direction.

3. A method of drying veneer in a dryer with at least the method steps of feeding, drying, cooling and discharging the veneer, whereby the veneer along a transport path of the veneer, whereby the veneer during drying and during cooling is rerouted a multiplicity of times between two transport belts or is exposed to pressure wherein the veneer is given an inclined orientation during feeding whereby an angle between a fiber direction of the veneer and a line perpendicular to a transport direction of the dryer amounts to 20° to 60°, and wherein the veneer is dried and cooled in said inclined orientation, the veneer during the feeding and during the discharge, as seen in the transport direction is transported with different speeds at left and right sides of said path.

4. A drying apparatus for drying veneer, comprising:

a method of drying veneer in a dryer with at least the method steps of feeding, drying, cooling and discharging the veneer, whereby the veneer along a transport path of the veneer, whereby the veneer during drying and during cooling is rerouted a multiplicity of times between two transport belts or is exposed to pressure wherein the veneer is given an inclined orientation during feeding whereby an angle between a fiber direction of the veneer and a line perpendicular to a transport direction of the dryer amounts to 20° to 60°, and wherein the veneer is dried and cooled in said inclined orientation;

a feed device with a suction box and a transport system with multiple belts;

a dryer following said feed device along a transport path of the veneer and provided with multiple fields and a transport system with a support belt and a cover belt;

a cooler following said dryer and provided with a transport system with a support belt; and a discharge device following said cooler along said transport path and provided with a transport system with multiple belts, whereby on the veneer in the dryer and in the cooler through multiple reroutings of the transport belts or by pressure rollers, pressure is applied at multiple locations, and whereby the speeds of the individual transport systems are controllably matched to one another, and whereby in the feed device and in the discharge device as seen in a transport direction of the veneer speeds of different magnitude are set for left and right sides.

5. The drying apparatus according to claim 4 wherein belts of the transport system of the feed device and the discharge device are respectively drivable with different speeds.

6. The drying apparatus according to claim 5 wherein the belts drivable with different speeds have belt disks of different diameters and a common drive.

7. The drying apparatus according to claim 5 wherein the drivable belts have respective disks with individually controllable drives.

8. The drying apparatus according to claim 4 wherein the feed device has off-center of a width of the transport path, a brake device for the veneer.

9. The drying apparatus according to claim 8 wherein the brake device is a vacuum nozzle having a controllable opening trained upon the veneer at a slight spacing from the transport path.

10. The drying apparatus according to claim 8 wherein said brake device comprises a ram carrying a rotatably journaled disk above the transport path and adapted to press said disk against the veneer.

* * * * *